United States Patent [19]

Toyoda

[11] 4,317,965

[45] Mar. 2, 1982

[54] THIN MINIATURIZED DYNAMIC-TYPE LOUDSPEAKER

[75] Inventor: Mitsuru Toyoda, Suwa, Japan

[73] Assignee: Kabushiki Kaisha Suwa Seikosha, Tokyo, Japan

[21] Appl. No.: 137,142

[22] Filed: Apr. 3, 1980

[30] Foreign Application Priority Data

Apr. 10, 1979 [JP] Japan ..... 54/43317
Apr. 10, 1979 [JP] Japan ..... 54/47118[U]

[51] Int. Cl.[3] ..... H04R 9/06

[52] U.S. Cl. ..... 179/115.5 R; 179/115.5 ES; 179/115.5 VC; 179/115.5 ME; 179/120

[58] Field of Search ..... 179/115.5 R, 115.5 ES, 179/115.5 ME, 115.5 H, 115.5 BS, 115.5 VC, 117, 119 R, 120; 181/171, 172

[56] References Cited

U.S. PATENT DOCUMENTS

| | | | |
|---|---|---|---|
| Re. 26,030 | 5/1966 | Marchand et al. | 179/120 |
| 1,478,709 | 12/1923 | Gernsback | 179/181 R |
| 1,808,297 | 6/1931 | Dempster | 179/115.5 ME |
| 1,930,186 | 10/1933 | Swallow | 179/115.5 R |
| 1,951,531 | 3/1934 | Ringel | 179/115.5 ME |

FOREIGN PATENT DOCUMENTS

| | | | |
|---|---|---|---|
| 168815 | 8/1951 | Austria | 179/115.5 ME |
| 920048 | 3/1947 | France | 179/115.5 ME |
| 416895 | 12/1946 | Italy | 179/115.5 ME |
| 47-36418 | 9/1972 | Japan | 179/115.5 VC |
| 383664 | 11/1932 | United Kingdom | 179/115.5 VC |
| 885991 | 1/1962 | United Kingdom | 179/115.5 ME |

*Primary Examiner*—George G. Stellar
*Attorney, Agent, or Firm*—Blum, Kaplan, Friedman, Silberman & Beran

[57] ABSTRACT

The dynamic loudspeaker formed with a vibration plate disposed between a yoke and a permanent magnet is provided. The vibration plate is substantially planar formed with a central projecting cylindrical region. A voice coil is disposed on the vertical wall of the central projecting region of the vibration plate. This planar construction of the vibration plate permits a miniaturized construction making the loudspeaker particularly well suited for use in portable electronic equipment having sound making capabilities.

9 Claims, 4 Drawing Figures

FIG. 2
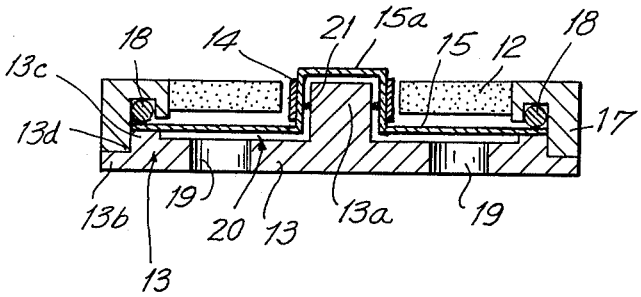
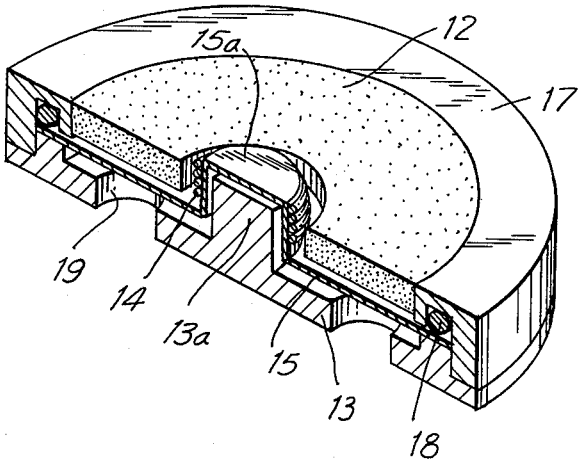
FIG. 3

THIN MINIATURIZED DYNAMIC-TYPE LOUDSPEAKER

BACKGROUND OF THE INVENTION

This invention relates generally to a dynamic-type loudspeaker, and more particularly to a miniaturized dynamic loudspeaker having a substantially planar vibration plate.

Dynamic-type loudspeakers have a broad regenerating frequency zone and may be made at relatively low cost. Thus, these loudspeakers find use in almost all types of sound making devices. The sound making devices include radios, tape recorders and timepieces, such as electronic wristwatches which require loudspeakers to be very small and thin. Thus, there is a need for the small and thin dynamic-type loudspeaker.

Another shortcoming of the conventional dynamic-type loudspeakers is the time consuming process required for manufacture. These steps include separate winding of wire for a voice coil and combining a bobbin to the vibration plate and the subsequent formation of terminals and the like. Thus, it cannot be said that the conventional dynamic-type loudspeaker can be mass produced. Given the many steps required, it is difficult to lower the cost of production. Additionally, when a vibration plate is assembled, unless the voice coil is set into the correct position in reference to the magnetic circuit, the required sound performance will not be obtained. Accordingly, it would be desirable to provide a miniaturized dynamic-type loudspeaker which can be manufactured at low cost under mass-production techniques. Additionally, it would be desirable to provide the dynamic-type loudspeaker of the required thin and small size for use in portable electronic equipment.

SUMMARY OF THE INVENTION

Generally speaking, in accordance with the invention, a dynamic-type loudspeaker having a substantially planar vibration plate is provided. The vibration plate is substantially planar with a central projecting cylindrical region. A voice coil is wound directly on the exterior vertical wall of the central projecting region of the vibration plate. The central projecting cylindrical region of the vibration plate is disposed over a yoke having a center pole and an outer raised flange for securing the vibration plate between the flange and an outer frame member. The permanent magnet is disposed between th central projecting region and the frame.

At least one opening may be provided in the yoke for creating a Helmholtz resonator. In another embodiment of the invention at least a portion of the planar vibration plate is formed with a thin conductive electrode deposited thereon.

Accordingly, it is an object of the invention to provide an improved dynamic-type loudspeaker.

Another object of the invention is to provide an improved miniaturized dynamic-type loudspeaker wherein the vibration plate is substantially planar.

A further object of the invention is to provide an improved dynamic-type loudspeaker wherein a substantially planar vibration plate is disposed between a permanent magnet and a yoke.

Still another object of the invention is to provide an improved miniaturized dynamic-type loudspeaker wherein the vibration plate includes a central projecting region on which the voice coil is disposed.

Still a further object of the invention is to provide an improved dynamic-type loudspeaker wherein a substantially planar vibration plate includes at least one region of a thin conductive region disposed thereon.

Yet another object of the invention is to provide an improved dynamic-type loudspeaker which can be easily manufactured and is small and thin for use in portable electronic devices having sound making capabilities.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a cross-sectional view illustrating the construction of a dynamic-type loudspeaker constructed and arranged in accordance with the invention;

FIG. 3 is a perspective view of a section of the dynamic-type loudspeaker depicted in FIG. 2.

DESCRIPTION OF THE PREFERRED EMBODIMENTS

Figure 1:
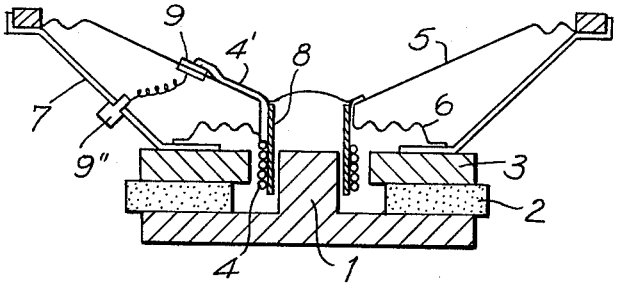
FIG. 1 PRIOR ART
FIG. 1 is a cross-sectional view of the conventional construction of a dynamic-type loudspeaker.

Referring now to FIG. 1, the construction of a conventional dynamic-type loudspeaker is shown. The loudspeaker includes a magnetic circuit formed of a center pole 1, a permanent magnet 2 mounted on center pole 1 and a yoke 3 disposed on permanent magnet 2. A substantially frusto-conical vibration plate 5 is secured within a frusto-conical frame 7 by a sealing ring. A voice coil 4 of copper wire is wound about a bobbin 8 which is formed from two layers of thin paper. Bobbin 8 is mounted to the central region of vibration plate 5. Voice coil terminal 9'' is connected to the voice coil 4 by a wire which leads to a terminal 9 on the diaphragm to which the free end 4' of the voice coil is connected. Bobbin 8 is also mechanically connected to frame 7 and yoke 3 by way of a resilient damper element 6.

It is evident from this type of construction that there are many steps involved in manufacturing a dynamic-type loudspeaker having a vibrator plate 5 of the type of FIG. 1. Also included is winding of the wire for voice coil 4 on bobbin 8, and mounting bobbin 8 to the central opening of vibration plate 5. In addition, voice coil 4 must be connected electrically to terminal 9 by wire 4'. Thus, one can readily see why manufacture of such dynamic-type loudspeakers is difficult.

The dynamic-type loudspeakers as illustrated in FIG. 1 operate as follows. When the loudspeaker electric current is applied to voice coil 4, a magnetic flux occurs which interacts with the magnetic field of permanent magnet 2 and voice coil 4 vibrates about center pole 1. This vibration of voice coil 4 is transmitted to vibration plate 5 thereby generating sound waves in the air within vibration plate 5. In this manner, the electrical oscillations are converted into mechanical vibrations which, in turn, produce the sound waves in the air. The density of the magnetic flux of the magnetic circuit, which includes permanent magnet 2, dicates the performance of the loudspeaker.

In order to construct a thin dynamic-type loudspeaker, based on the construction of FIG. 1, requires a reduction in thickness of permanent magnet 2. Moreover, reduction of the size of permanent magnet 2 decreases the density of the magnetic flux which results in deterioration of the performance of the loudspeaker. Accordingly, there is no effective way to make a dynamic-type loudspeaker based on the construction of FIG. 1 sufficiently thin for use in portable electronic devices, such as a wristwatch.

FIG. 2 includes a construction of a dynamic-type loudspeaker, in accordance with the invention, which overcomes the shortcomings of the conventional construction. In FIGS. 2 and 3, a cross-sectional view illustrating one embodiment of the invention is shown. The dynamic-type loudspeaker, in accordance with the invention, includes a substantially circular yoke 13 having a center pole 13*a*. Yoke 13 is formed with an outwardly extending flange 13*b* and a peripheral upwardly extending flange 13*c* for defining a peripheral seating groove 13*d* therearound for receiving a circular frame 17 as will be described in more detail below.

The loudspeaker of FIG. 2 includes a substantially planar vibration plate 15 unitarily formed with a central perpendicularly disposed cylindrical region 15*a*. A voice coil 14 is disposed about the exterior vertical wall of vibration plate projecting region 15*a*. Vibration plate 15 is disposed over center pole 13*a* of yoke 13 with the peripheral regions of vibration plate 15 secured at upwardly projecting flange 13*c* by a resilient packaging member 18 disposed within a U-shaped groove formed in frame 17. A substantially circular permanent magnet 12 having a central opening is disposed within frame 17 and spaced apart from vibration plate 15. In this construction, a magnetic circuit includes permanent magnet 12, yoke 13 and frame 17.

Permanent magnet 12, vibration plate 15 and yoke 13 are each substantially planar and disposed one on top of each other, respectively. By utilizing vibration plate 15, including projecting region 15*a* permits use of permanent magnet 12 within the space between voice coil 15 and the upper edge of projecting region 15*a* of vibration plate 15. This permits use of a magnet of increased size so that the density of the magnetic flux is also increased. The overall size of the loudspeaker does not become as large as that of the construction in FIG. 1 wherein the thickness of the permanent magnet is added to the height of the frusto-conical vibration plate. In the construction in accordance with the invention as illustrated in FIG. 2, the overall thickness of the loudspeaker is dictated by the height of the projecting region 15*a* of vibration plate 15.

Accordingly, by providing a construction, as illustrated in FIG. 2, the dynamic-type loudspeaker can be easily reduced in size. This is the case because vibration plate 15 is secured between permanent magnet 12 and yoke 13. Moreover, assembly of the dynamic-type loudspeaker, illustrated in FIG. 2, is simplified as vibration plate 15 is secured by resilient packing member 18. Resilient packing member 18 also provides a construction which is air-tight and waterproof.

With conventional constructions, when the dynamic-type loudspeaker is reduced in size, the vibration plate becomes so small in proportion to the magnetic circuit that the sound volume deteriorates. However, this type of deterioration of sound volume can be prevented in the construction illustrated in FIG. 2 by providing a small hole 19 in yoke 13. Small hole 19 in yoke 13 forms a Helmholtz resonator utilizing the volume between yoke 13 and the under surface of vibration plate 15. This permits a reduction in the overall size of the loudspeaker without sacrificing the sound making capabilities.

Referring now to FIG. 1, in the conventional dynamic-type loudspeaker damper 6 is disposed between bobbin 8 and frame 7. A damper for limiting excessive displacement of vibration plate 15 may also be provided in the construction in accordance with the invention in FIG. 2. A damper 21 may be disposed between center pole 13*a*, of yoke 13, and the internal wall of projecting region 15*a* of vibration plate 15. Thus, the effect obtainable in the conventional construction may also be obtained in a dynamic-type loudspeaker constructed and arranged in accordance with the invention without increasing the thickness of the loudspeaker.

Figure 4:
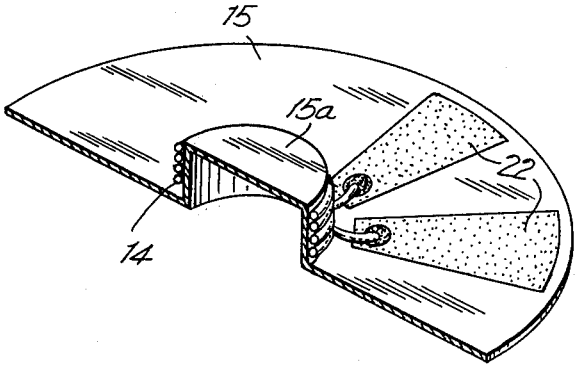
FIG. 4 is a perspective view of a section of a vibration plate constructed and arranged in accordance with a further embodiment of the invention.

Turning now to FIG. 4, vibration plate 15 having central projecting region 15*a* constructed and arranged in accordance with the invention is shown. Projection portion 15*a* is formed by heating and pressing a planar vibration plate and is formed without any holes. Voice coil 14 is wound directly about the vertical wall of projecting portion 15*a*. In accordance with this embodiment of the invention, the acoustical response of vibration plate 15 is improved by providing at least one terminal region 22 on the planar surface of vibration plate 15. Terminal 22 is formed of a thin conductive plate and is secured to vibration plate 15 and electrically connected to voice coil 14.

Vibration plate 15, in accordance with this embodiment of the invention, is easily made by securing vibration plate 15 to a winding mandrel (not shown) and winding the wire for forming voice coil 14 directly on projecting portion 15*a*. This allows omission of the complex operations involved in constructing the conventional loudspeaker of FIG. 1. The steps avoided include fixing bobbin 8 to vibration plate 5 which is difficult for a thin and small loudspeaker. In addition, the ends of the wires for forming voice coil 14 are connected directly to terminals 22 so that this process may be done at the same time winding of voice coil 14 is performed. Thus, the assembly process is simplified. Vibration plate 15 may be formed from a flexible substrate and a copper leaf may be utilized for terminals 22. Voice coil 14 and terminals 22 may be manufactured by etching at the same time thus further simplifying construction of the dynamic-type loudspeaker in accordance with the invention. Moreover, by forming projecting portion 15*a* before assembly, the external form is determined and fixes the appropriate position of the magnetic circuit and suitable sound reproduction performance is insured.

Vibration plate 15, of FIG. 4, is shown without any holes in projecting portion 15*a*. This is in contrast to the central opening in vibration plate 5 of the conventional construction shown in FIG. 1 wherein the opening must be cut by a press. If the magnetic circuit for vibration plate 15 is of the type so that a hole may be avoided, vibration plate 15 can be utilized in the form that it is in. Thus, vibration plate 15 constructed in accordance with the invention is indeed convenient. The dynamic-type loudspeakers obtained, based on this construction, are simplified and may be produced sufficiently thin to be used in portable electronic devices, particularly in wristwatches.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A dynamic-type loudspeaker comprising;

a unitary vibration plate within the magnetic circuit of the loudspeaker, said vibration plate having a substantially circular planar portion formed with a central perpendicular cylindrical projecting region having a region parallel to the planar portion;

a voice coil wound about the cylindrical wall of the projecting region of the vibration plate;

a substantially planar yoke having a perpendicular cylindrical central pole dimensioned to cooperate with the projecting region of said vibration plate, said yoke formed with seating means for receiving the vibration plate at the periphery thereof and maintaining the vibration plate spaced apart from said yoke, said vibration plate disposed on said seating means; and a frame member dimensioned to cooperate with said seating means and including a disc-shaped permanent magnet having a central opening mounted in said frame, said frame member positioned on said seating means about said voice coil and projecting region and overlying and spaced apart from said vibration plate, said frame member supporting the disc-shaped permanent magnet at the circumference thereof and waterproof packing means disposed in the frame member compressed between the frame member and the circumference of said vibration plate.

2. The dynamic-type loudspeaker of claim 1, wherein said yoke is formed with at least one opening therethrough for forming a Helmholtz resonator in the volume between said yoke and said vibration plate.

3. The dynamic-type loudspeaker of claim 1, wherein said seating means is an axially extending peripheral flange for seating said vibration plate and further includes an outwardly extending radial flange for forming a seat for receipt of said frame member.

4. The dynamic-type loudspeaker of claim 3, wherein said packing means is a resilient gasket and said frame member is formed with a groove for receipt of said gasket, said frame engages said yoke at the peripheral flange and said gasket engages said vibration plate.

5. The dynamic-type loudspeaker of claim 1, wherein said voice coil is formed of a conductive thin plate.

6. The dynamic-type loudspeaker of claim 1, further including at least one region of a thin conductive film on a portion of the planar surface of the vibration plate, said conductive film electrically connected to the voice coil.

7. The dynamic-type loudspeaker of claim 6, further including at least one opening formed through said yoke for forming a Helmholtz resonator in the region between said yoke and said vibration plate.

8. A dynamic-type loudspeaker comprising:

a circular substantially planar yoke having a center pole, an outwardly extending peripheral flange and a peripheral flange extending perpendicular to the planar region adjacent said peripheral flange for forming a seat;

a unitary substantially planar vibration plate within the magnetic circuitry of the loudspeaker, said vibration plate formed with a central, cylindrical projecting region having a region parallel to the planar region of the plate dimensioned to cooperate with the center pole of the yoke, the vibration plate disposed on the upwardly extending peripheral flange;

a voice coil mounted on the projecting region of the vibration plate;

a circular frame member including a substantially circular, planar permanent magnet having a central opening mounted at the circumference thereof to the frame, said magnet dimensioned to fit about the voice coil, and said frame formed with an internal axial U-shaped groove and a resilient packing member disposed in the groove, the frame member dimensioned to engage the seat with the packing member biased against said vibration plate.

9. The dynamic-type loudspeaker of claim 8, including two openings in said yoke.

* * * * *